US008672146B1

(12) United States Patent
Cole

(10) Patent No.: US 8,672,146 B1
(45) Date of Patent: Mar. 18, 2014

(54) NECKWEAR AND JEWELRY STORAGE DEVICE

(76) Inventor: Douglas L. Cole, Sacramento, CA (US)

( * ) Notice: Subject to any disclaimer, the term of this patent is extended or adjusted under 35 U.S.C. 154(b) by 646 days.

(21) Appl. No.: 12/655,262

(22) Filed: Dec. 28, 2009

Related U.S. Application Data

(60) Provisional application No. 61/204,193, filed on Dec. 31, 2008.

(51) Int. Cl.
*A47F 7/02* (2006.01)

(52) U.S. Cl.
USPC ..... 211/85.2; 211/117; 248/328; 248/332

(58) Field of Classification Search
USPC ..... 211/85.2, 123, 105.1, 117, 45, 13, 118; 160/301, 339, 11; 108/96, 106, 149, 108/146, 164; 182/199; 248/320, 323, 248/327–329, 332
See application file for complete search history.

(56) References Cited

U.S. PATENT DOCUMENTS

| | | | | | |
|---|---|---|---|---|---|
| 53,516 | A | * | 3/1866 | Yerkes | 211/74 |
| 121,722 | A | * | 12/1871 | Keene | 211/85.3 |
| 247,382 | A | | 9/1881 | McCallen | |
| 322,330 | A | * | 7/1885 | Snow | 211/209 |
| 674,673 | A | * | 5/1901 | Dauber | 211/117 |
| 804,906 | A | * | 11/1905 | Wheeler | 211/117 |
| 1,090,837 | A | * | 3/1914 | Clarke | 211/117 |
| 1,132,514 | A | * | 3/1915 | Corner | 211/117 |
| 1,185,167 | A | * | 5/1916 | Bishop | 211/117 |
| 1,202,166 | A | * | 10/1916 | Corbett | 211/117 |
| 1,370,981 | A | * | 3/1921 | McGowan | 211/113 |
| 1,516,091 | A | * | 11/1924 | Gordon | 211/117 |
| 1,769,805 | A | | 7/1930 | Soloff | |
| 1,975,543 | A | | 10/1934 | Giessler | |
| 2,139,781 | A | * | 12/1938 | Trammell | 160/172 R |
| 2,419,249 | A | * | 4/1947 | Bridges | 211/117 |
| 2,513,724 | A | * | 7/1950 | Hebenstreit | 211/45 |
| 2,562,622 | A | * | 7/1951 | Laughlin | 211/100 |
| 2,643,662 | A | * | 6/1953 | Bunce | 134/164 |
| 3,130,439 | A | * | 4/1964 | Bovaird | 15/268 |
| 3,550,784 | A | * | 12/1970 | Batts | 211/116 |
| 3,853,225 | A | | 12/1974 | Gegauff | |
| 3,872,972 | A | * | 3/1975 | Cummins et al. | 211/17 |
| 4,067,454 | A | * | 1/1978 | Helbling | 414/26 |
| 4,108,084 | A | * | 8/1978 | Fink | 108/29 |
| 4,122,559 | A | * | 10/1978 | Kelly | 4/608 |
| 4,422,556 | A | * | 12/1983 | Moore | 211/119 |
| 4,429,797 | A | | 2/1984 | Collins | |
| 4,732,269 | A | * | 3/1988 | Roy | 206/751 |
| 4,782,882 | A | * | 11/1988 | Amedeo et al. | 160/178.1 R |
| 5,052,648 | A | * | 10/1991 | Landau | 248/235 |
| 5,067,621 | A | | 11/1991 | Alexander | |
| 5,176,266 | A | * | 1/1993 | Gillet | 211/90.04 |
| 5,242,048 | A | * | 9/1993 | Ellingsworth et al. | 206/6.1 |
| 5,749,479 | A | * | 5/1998 | Belokin et al. | 211/113 |
| 5,979,671 | A | * | 11/1999 | Pan et al. | 211/1.57 |
| 6,006,963 | A | | 12/1999 | Pain | |
| 6,044,523 | A | * | 4/2000 | Ortega | 16/442 |
| 6,047,759 | A | * | 4/2000 | Lysyj | 160/84.04 |
| 6,102,216 | A | * | 8/2000 | Frank | 211/85.3 |

(Continued)

*Primary Examiner* — Korie H Chan
(74) *Attorney, Agent, or Firm* — Dennis A. DeBoo

(57) ABSTRACT

A vertically adjustable combination neckwear and jewelry storage device comprised of a head rail assembly, a jewelry rail assembly, and a plurality of neckwear rods operatively connected together such that jewelry rail assembly and the plurality of neckwear rods vertically adjust with respect to the head rail assembly.

8 Claims, 5 Drawing Sheets

(56) References Cited

U.S. PATENT DOCUMENTS

| | | | | |
|---|---|---|---|---|
| 6,237,781 | B1 * | 5/2001 | Dahl | 211/17 |
| 6,327,803 | B1 * | 12/2001 | Ruderman | 40/601 |
| RE38,463 | E * | 3/2004 | Anderson et al. | 248/329 |
| 6,905,035 | B2 * | 6/2005 | McKinney, Jr. | 211/85.3 |
| 7,165,688 | B2 * | 1/2007 | Cameron | 211/105.1 |
| 7,293,664 | B2 * | 11/2007 | Belokin et al. | 211/113 |
| 7,367,548 | B2 * | 5/2008 | Rosenfeldt et al. | 254/338 |
| 7,762,409 | B2 * | 7/2010 | Vickroy | 211/113 |
| 2006/0207952 | A1 * | 9/2006 | Timmons | 211/85.3 |
| 2007/0175772 | A1 * | 8/2007 | Cunningham | 206/6.1 |

* cited by examiner

NECKWEAR AND JEWELRY STORAGE DEVICE

CROSS-REFERENCE TO RELATED APPLICATIONS

This application claims priority under 35 USC Section 119(e) to U.S. Provisional Patent Application No. 61/204,193, filed Dec. 31, 2008, the entire disclosure of which is incorporated herein by reference.

FIELD OF THE INVENTION

This invention relates generally to a neckwear and jewelry storage device, and, in particular, to a vertically, adjustable combination neckwear and jewelry storage device for holding neckwear such as neckties and scarves and for holding jewelry such as tie tacks, cuff links, wrist watches, and other jewelry for convenient accessibility from, for example, a closet ceiling installation.

BACKGROUND OF THE INVENTION

Prior necktie racks typically hold an assortment of neckties from a clothes rod in a closet. This arrangement generally results in the necktie assortment becoming crowded by other cloths items on the clothes rod. Accordingly, this crowding makes it difficult to see individual neckties to make a specific selection suited for a given day or event and selecting a necktie from this crowded necktie assortment without having to interact with other clothes becomes a challenge.

Additionally, prior necktie racks that have been moved to the closet door have been objected to as a result of being inconvenient to use, bulky, and generally interfering with the operation of the closet door.

Furthermore, prior tie racks have been moved to other locations in the closet. For example, U.S. Pat. No. 5,067,621, issued Nov. 26, 1991 to Alexander discloses a multi-level suspended garment holder which utilizes a coil having a descending slope for the main garment hanging area and a pulley system coupled between a horizontal ceiling and a vertical wall of the closet for positioning the coil between one of two positions. This configuration is problematic in that the ties tend to slide down the descending slope of the coil and crowd together which results in the ties becoming susceptible to wrinkling, difficult to see, and difficult to remove. Additionally, this configuration is problematic in that the two wall pulley system is cumbersome to operate. Furthermore, Alexander discloses an optional electric motor hoist which adds substantial cost and the requirement of electrical power.

In view of the foregoing, there is a need for a necktie rack that overcomes the significant shortcomings of the known prior-art as delineated hereinabove.

BRIEF SUMMARY OF THE INVENTION

Accordingly, and in one aspect, an embodiment the present invention provides a device that moves the neckties off a cloths rod of a closet to an unused space in the closet. Additionally, and in one aspect, an embodiment the present invention provides a device that includes at least one vertically adjustable horizontal support member on which a plurality of neckties are centrally draped over such that the plurality of neckties vertically extend from a horizontal support plane. Hence, an embodiment the present invention provides a device that provides an arrangement of neckties that precludes the ties from sliding into and crowding one another thereby abating wrinkling of the ties from crowding while clearly supporting the ties for easy removal.

Additionally, an embodiment the present invention provides a device that presents the neckties in a horizontal fashion for making a specific selection suited for a given day or event a much more efficient task.

Furthermore, an embodiment the present invention provides a device that presents the neckties in a horizontal fashion for making color coordination with shirts a much more efficient task.

Moreover, and in one embodiment, the device is further comprised of at least one vertically adjustable jewelry storage channel for holding jewelry in a horizontal plane.

More particularly, and in one aspect, an embodiment the present invention provides a vertically adjustable combination neckwear and jewelry storage device comprising: a head rail assembly; a jewelry rail assembly disposed substantially parallel to and vertically below the head rail assembly; a plurality spaced apart neckwear rods disposed substantially parallel to and vertically below the jewelry rail assembly; means for suspending the jewelry rail assembly substantially parallel to and vertically below the head rail assembly and for suspending the plurality of spaced apart neckwear rods substantially parallel to and vertically below the jewelry rail assembly; and means provided in the head rail assembly for retaining or releasing the suspending means for vertically raising or lowering the jewelry rail assembly simultaneously with the plurality of spaced apart neckwear rods relative to the head rail assembly for providing vertical adjustability and retention of the jewelry rail assembly and the plurality of spaced apart neckwear rods relative to the head rail assembly.

Accordingly, having thus summarized the invention, it should be apparent that numerous modifications and adaptations may be resorted to without departing from the scope and fair meaning of the present invention as set forth hereinbelow by the claims.

DETAILED DESCRIPTION OF THE INVENTION

Figure 1:
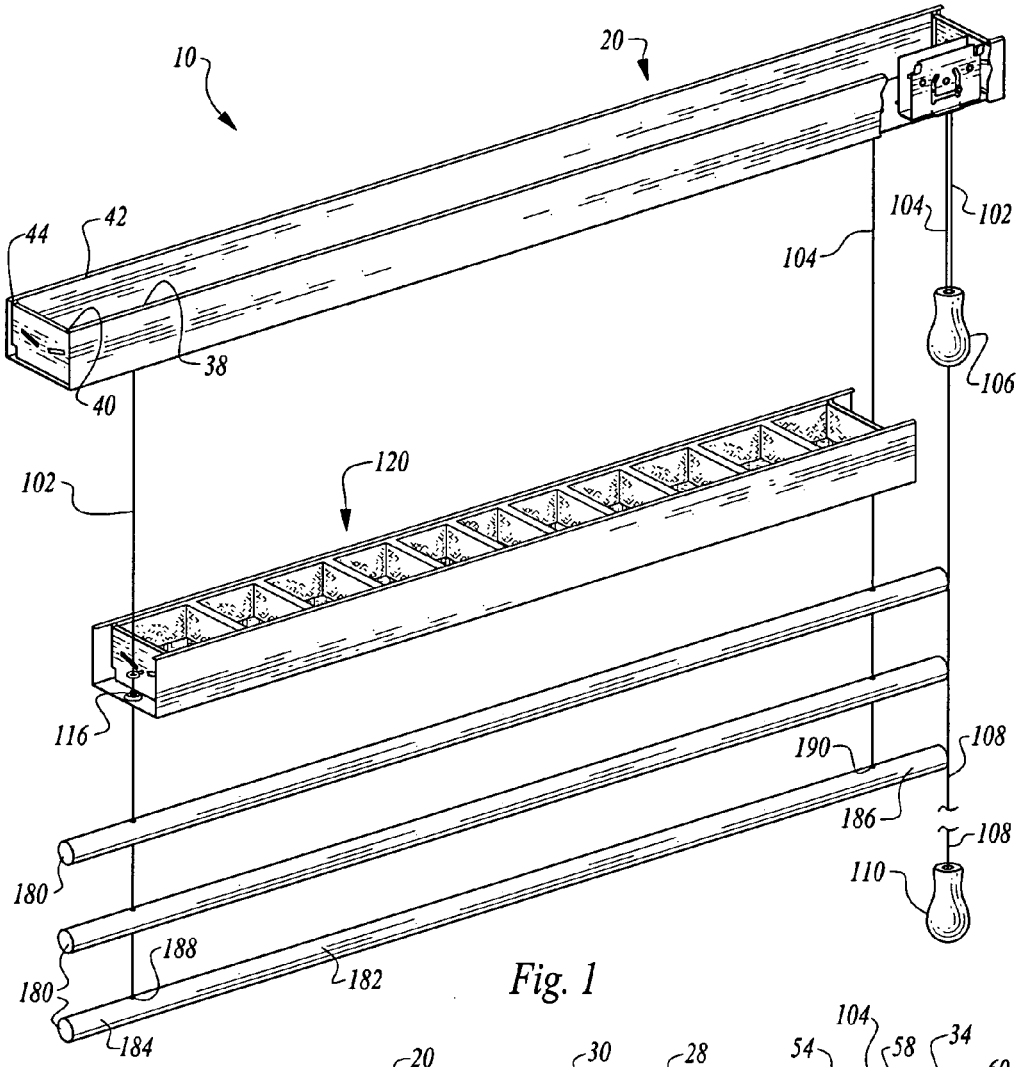
FIG. 1 is a front perspective view of an embodiment of a neckwear and jewelry storage device.

Considering the drawings, wherein like reference numerals denote like parts throughout the various drawing figures, reference numeral 10 is directed to a neckwear and jewelry storage device.

Referring to FIG. 1, and in one embodiment, the neckwear and jewelry storage device 10 is comprised of a hollow, open top head rail assembly 20, a jewelry tray or rail assembly 120 disposed beneath the head rail assembly 20, and a plurality of necktie or neckwear rods 180 disposed beneath the jewelry tray or rail assembly 120. Spaced apart vertical cords 102 and 104 extend through respective holes in the plurality of necktie rods 180 and are secured thereto using set screws or knots. The vertical cords 102 and 104 also pass through respective eye bolts of the jewelry tray or rail assembly 120 and through cord eye guides of the open top head rail assembly 20 out through a cord lock device 64 of the assembly 20 where the cords terminate to ends connected to a first tassel 106 which, in turn, is connected to one end of an extension cord 108 which terminates at another end connected to a second tassel 110 which is used to apply a force from a user to raise and lower the necktie rods 180 and jewelry tray or rail assembly 120 toward and away from the head rail assembly 20.

Head Rail Assembly

Figure 2:
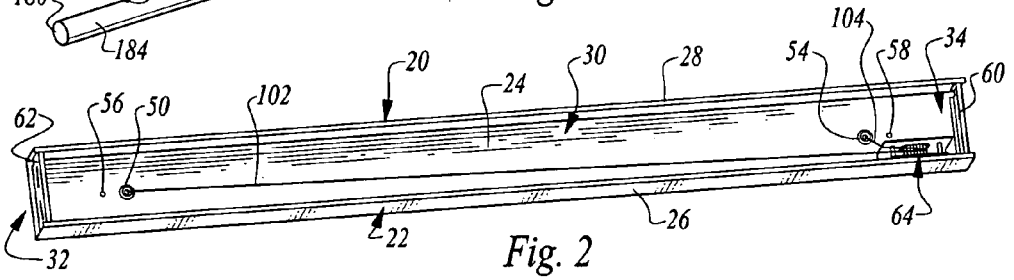
FIG. 2 is a top perspective view of an embodiment of a head rail assembly of the neckwear and jewelry storage device.

More specifically, and referring to FIGS. 1 and 2, one embodiment of the head rail assembly 20 comprises an elongated head rail body 22 having a generally U-shaped cross-section and comprised of a longitudinally extending, rectangularly shaped bottom wall 24, a longitudinally extending, rectangularly shaped front side wall 26 upwardly extending from a front longitudinal edge of the bottom wall 24, and a longitudinally extending, rectangularly shaped rear side wall 28 opposing the front side wall 26 and upwardly extending from a back longitudinal edge of the bottom wall 24. The head rail body 22 further comprises an open top end 30, a first open side end 32, a second open side end 34. The bottom wall 24, the opposing front and rear side walls 26 and 28, and the open top end 30 define a longitudinally extending channel extending between said first and second ends 32 and 34 of the head rail body 22.

Additionally, the front side wall 26 includes an inwardly and downwardly rolled upper end or lip 38 defining a longitudinally extending front under groove 40. Similarly, the rear side wall 28 includes an inwardly and downwardly rolled upper end or lip 42 defining a longitudinally extending rear under groove 44.

Furthermore, and referring to FIGS. 2 and 3, the bottom wall 24 of the head rail body 22 includes a cord lock cut-out 46, cord eye guide aperture 48 receiving a cord eye guide 50, a cord eye guide aperture 52 receiving a cord eye guide 54, and anchor apertures 56 and 58 for the reception of conventional wall anchors described further below.

In one embodiment, the head rail body 22 is formed from, but not limited to, sheet metal and is dimensioned to receive commercially available parts such as either low or high profile Venetian blind parts, which will be described further below. Moreover, commercially available low or high profile head rails can be employed for the head rail body 22 and retrofitted with the cord eye guide aperture 48 for receiving the cord eye guide 50, the cord eye guide aperture 52 for receiving cord eye guide 54, and the anchor apertures 56 and 58 for receiving conventional wall anchors described further below.

Referring to FIGS. 1 and 2, and in one embodiment, the head rail assembly 20 is also comprised of an end cap or plug 60 for removably closing the second open side end 34 adjacent the cord lock cut-out 46 and an end stiffener or lock 62 for closing the first open side end 32 and providing stiffness to the head rail body 22. One of a variety of commercially available Venetian blind end caps or plugs can be employed for the end cap or plug 60 and one of a variety of commercially available Venetian blind end stiffeners or locks can be employed for the end stiffener or lock 62.

Still referring to FIGS. 1 and 2, the head rail assembly 20 is further comprised of a cord lock device 64 that is implemented by a conventional, suitable, and commercially available Venetian blind cord lock device. Accordingly, the cord lock device 64 is a type of device which will now be evident to those having ordinary skill in the art, informed by the present disclosure.

Figure 3:
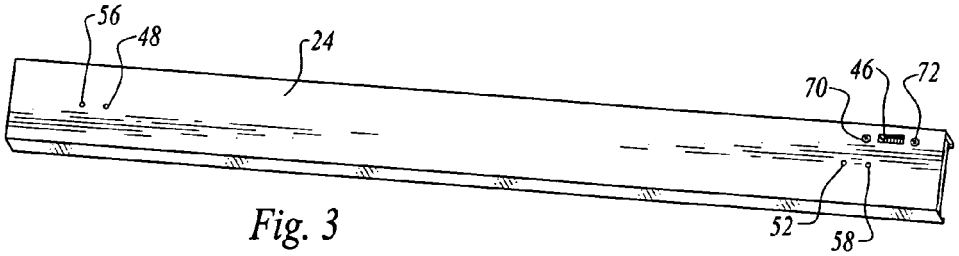
FIG. 3 is a bottom perspective view of the head rail assembly of the neckwear and jewelry storage device.
Figure 4:
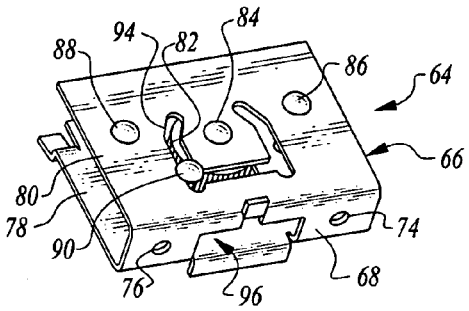
FIG. 4 is back perspective view of an embodiment of a cord lock device of the neckwear and jewelry storage device.
Figure 5:
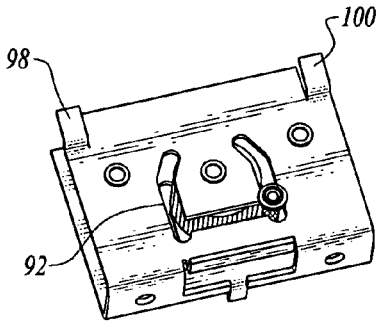
FIG. 5 is front perspective view of the cord lock device of the neckwear and jewelry storage device.
Figure 6:
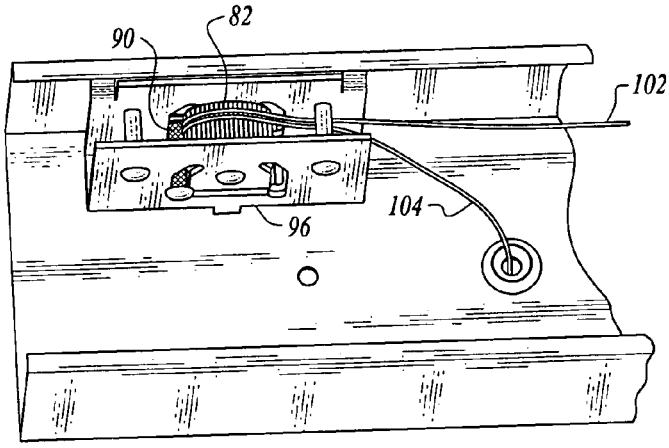
FIG. 6 is top and back perspective view of the cord lock device of the neckwear and jewelry storage device shown disposed in a partially fragmented head rail body of the head rail assembly.

Notwithstanding, and referring to FIGS. 4 and 5, the cord lock device 64 comprises a cord lock housing 66 which may for instance be stamped out from an integral piece of metal. Housing 66 has a base 68 which is connected to the head rail 22 of the device 10 by screws 70 and 72 (FIG. 3) extending through apertures in the bottom wall 24 of the head rail 22 and through threaded bores 74 and 76 in the base 68 of the cord lock device 64. The housing 66 has two sidewalls 78 and 80 rising upwardly at substantially right angles to the base 68. A stationary or rotatable metal pulley 82 extends between sidewalls 78 and 80 and is held in place by rivet 84. Rivets 86 and 88 are also used between upper portions of the sidewalls 78 and 80 to provide further rigidity to the cord lock housing 66. In one embodiment, a serrated or knurled rivet or cam 90 floats within slots 92 and 94 provided respectively in sidewalls 78 and 80. The slots are identical and in alignment with each other. In the center of base 68 there is large opening 96. Tabs 98 and 100 (FIG. 5) lock into the front under groove 40 formed by lip 38 of the front side wall 26 as illustrated in FIGS. 1 and 6. Additionally, FIG. 6 illustrate how the lift cords 102 and 104 of the device 10 pass from underneath through opening 96 between the serrated cam 90 and the pulley 82 and, from there, over pulley 82 such that the cords 102 and 104 are releasably locked between cam 90 and pulley 82.

Jewelry Rail Assembly

Figure 7:
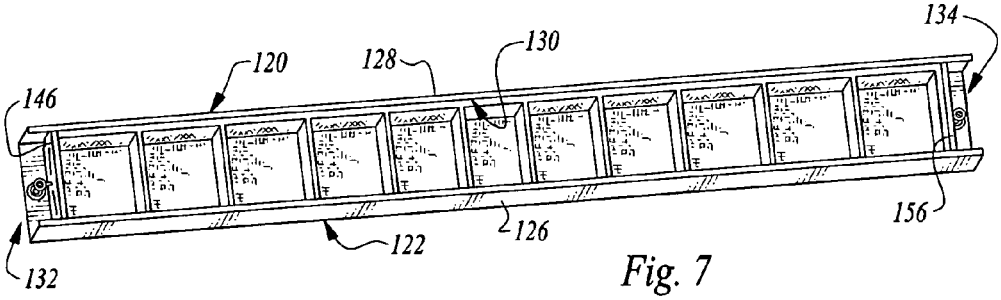
FIG. 7 is a top perspective view of an embodiment of a jewelry tray or rail assembly of the neckwear and jewelry storage device.
Figure 8:
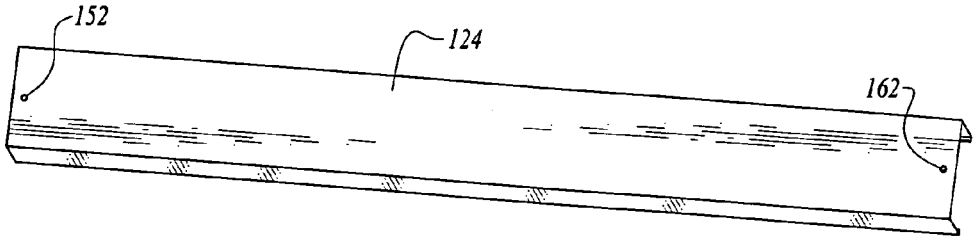
FIG. 8 is a bottom perspective view of the jewelry tray or rail assembly of the neckwear and jewelry storage device.

Referring to FIGS. 1, 7, and 8, and in one embodiment, the neckwear and jewelry storage device 10 is further comprised of the jewelry tray or rail assembly 120 disposed beneath the head rail assembly 20.

In one embodiment, the jewelry tray assembly 120 comprises an elongated jewelry rail body 122 having a generally U-shaped cross-section and comprised of a longitudinally extending, rectangularly shaped bottom wall 124, a longitudinally extending, rectangularly shaped front side wall 126 upwardly extending from a front longitudinal edge of the bottom wall 124, and a longitudinally extending, rectangularly shaped rear side wall 128 opposing the front side wall 126 and upwardly extending from a back longitudinal edge of the bottom wall 124. The jewelry rail body 122 further comprises an open top end 130, a first open side end 132, and a second open side end 134. The bottom wall 124, the opposing front and rear side walls 126 and 128, and the open top end 130 define a longitudinally extending channel extending between the first and second open ends 132 and 134 of the jewelry rail body 122.

Figure 9:
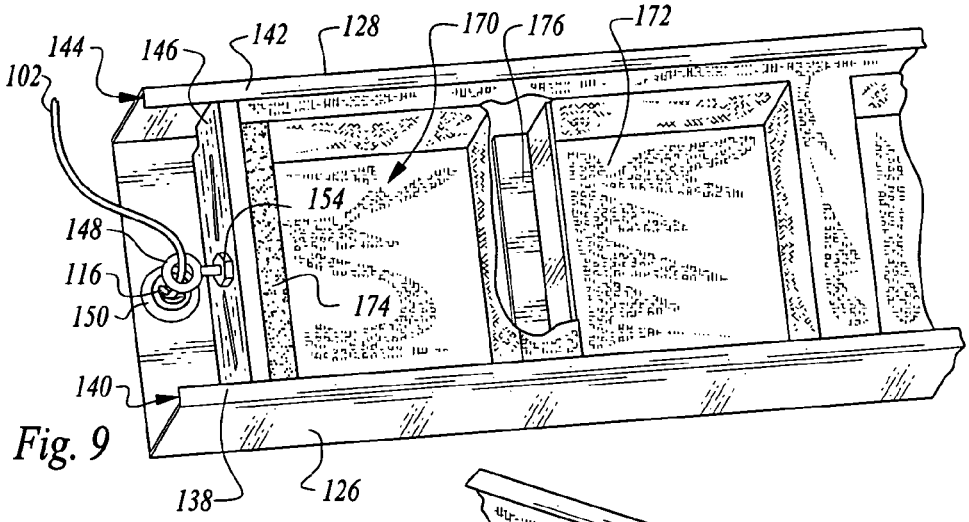
FIG. 9 is a fragmentary top perspective view of a first end of the jewelry tray or rail assembly of the neckwear and jewelry storage device. a partially fragmented
Figure 10:
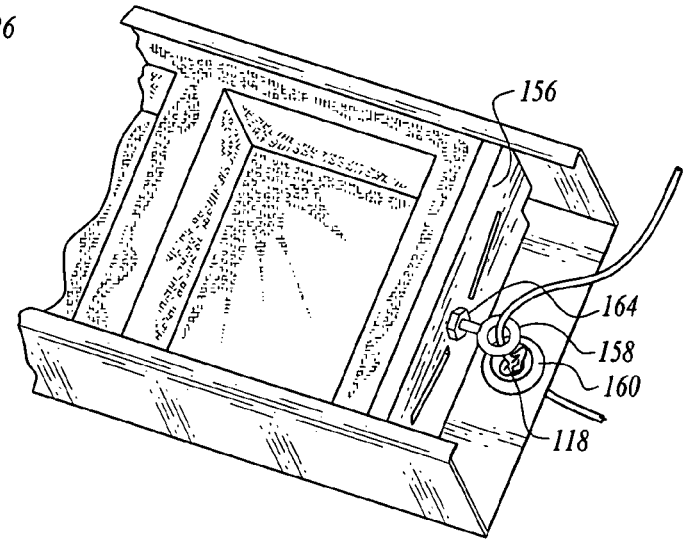
FIG. 10 is a fragmentary top perspective view of a second end of the jewelry tray or rail assembly of the neckwear and jewelry storage device.

Additionally, and referring to FIG. 9, the front side wall 126 includes an inwardly and downwardly rolled upper end or lip 138 defining a longitudinally extending front under groove 140. Similarly, the rear side wall 128 includes an inwardly and downwardly rolled upper end or lip 142 defining a longitudinally extending rear under groove 144. Upholstery (padding and material such as velvet) is tucked under the grooves 140 and 142.

Furthermore, and referring to FIGS. 7 through 10, one embodiment of the jewelry tray or rail assembly 120 is comprised of a first end stiffener 146 disposed within the channel of the jewelry rail body 122 at a location slightly interior of the first open side end 132. The first end stiffener 146 includes a first connected eye bolt 148 in alignment with a cord eye guide 150 positioned within an aperture 152 disposed in the bottom wall 124 of the jewelry rail body 122 at an area adjacent the first open side end 132. Bolts 154 may be used on either side of the first end stiffener 146 to connect the eyebolt thereto. An end cap can be used to close the first open side end 132 and cover the eye bolt 148. Additionally, cord 102 passes through the cord eye guide 150 and the first connected eye bolt 148 and the cord is provided with a knot 116 at a location between the cord eye guide 150 eye bolt 148 to preclude the assembly 120 from traversing onto the plurality of necktie rods 180. Furthermore, the cord may pass through a washer interposed between the cord eye guide and the knot 116 provided in cord 102.

The jewelry tray or rail assembly 120 is further comprised of a second end stiffener 156 disposed within the channel of the jewelry rail body 122 at a location slightly interior of the second open side end 134. The second end stiffener 156 includes a second connected eye bolt 158 in alignment with a cord eye guide 160 positioned within an aperture 162 disposed in the bottom wall 124 of the jewelry rail body 122 at an area adjacent the second open side end 134. Bolts 164 may be used on either side of the second end stiffener 156 to connect the eyebolt thereto. An end cap can be used to close the second open side end 134 and cover the eye bolt 158. Additionally, cord 104 passes through the cord eye guide 160 and the second connected eye bolt 158 and is provided with a knot 118 at a location between the cord eye guide 160 and eye bolt 158 to preclude the assembly 120 from traversing onto the plurality of necktie rods 180. Furthermore, the cord 104 may pass through a washer interposed between the cord eye guide 160 and the knot 118 provided in cord 104.

One of a variety of commercially available Venetian blind end stiffeners can be employed for the end stiffeners 146 and 156 and one of a variety of commercially available Venetian blind end caps can be employed for the end caps closing side ends 132 and 134.

Moreover, the longitudinally extending channel of the jewelry rail body 122 is partitioned into a plurality of upholstered compartments 170 comprised of a velvet layer 172 overlying a foam layer 174. In one embodiment, a plurality of spaced apart L-shaped brackets 176 are employed to partition the longitudinally extending channel of the jewelry rail body 122. Each L-shaped bracket is comprised of a bottom leg connected to an interior surface of the bottom wall 124 with, for example, tape or adhesive. Additionally, each L-shaped bracket includes a vertical wall upwardly extending at a substantially right angle to its bottom leg for forming a partition between two adjacent compartments or between one compartment and one end stiffener. Foam 174 is then layered at the bottom of each compartment to cover any exposed area of the interior surface of the bottom wall 124 and any exposed area of the bottom leg of each L-shaped bracket. Foam is also layered on each side of each vertical wall of each L-shaped bracket. The foam 174 is then covered with the velvet material 172 for providing the plurality of upholstered compartments 170 comprised of velvet overlying foam.

Necktie Rods

Figure 11:
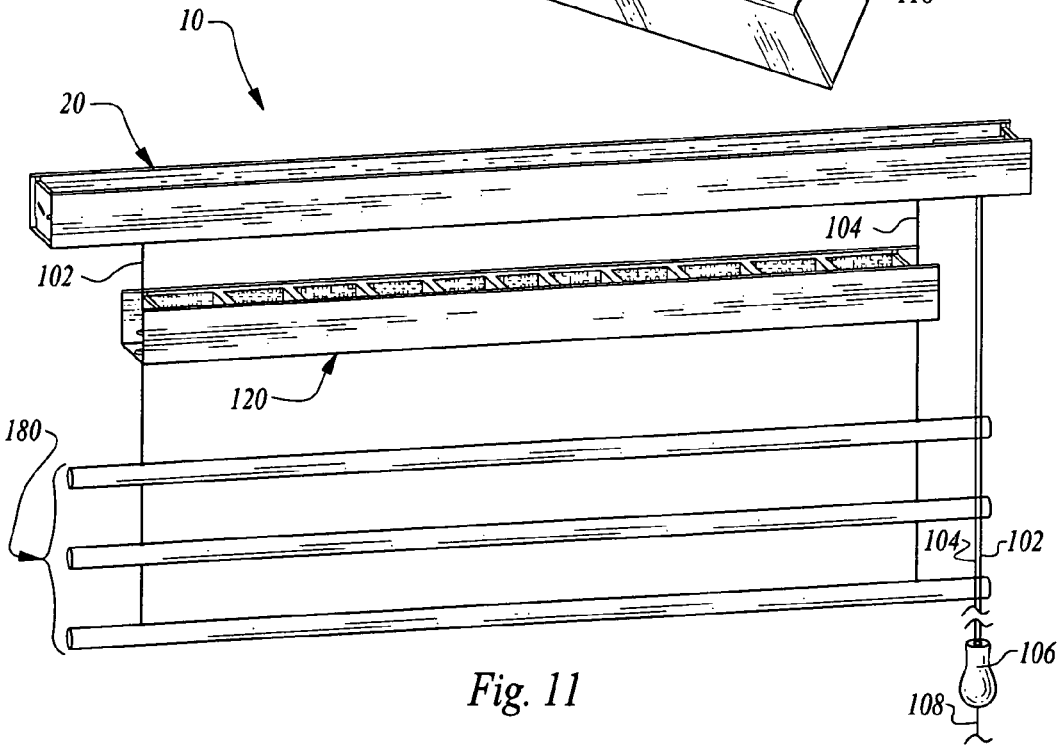
FIG. 11 is a front perspective view of the neckwear and jewelry storage device shown in a raised or retracted position.
Figure 12:
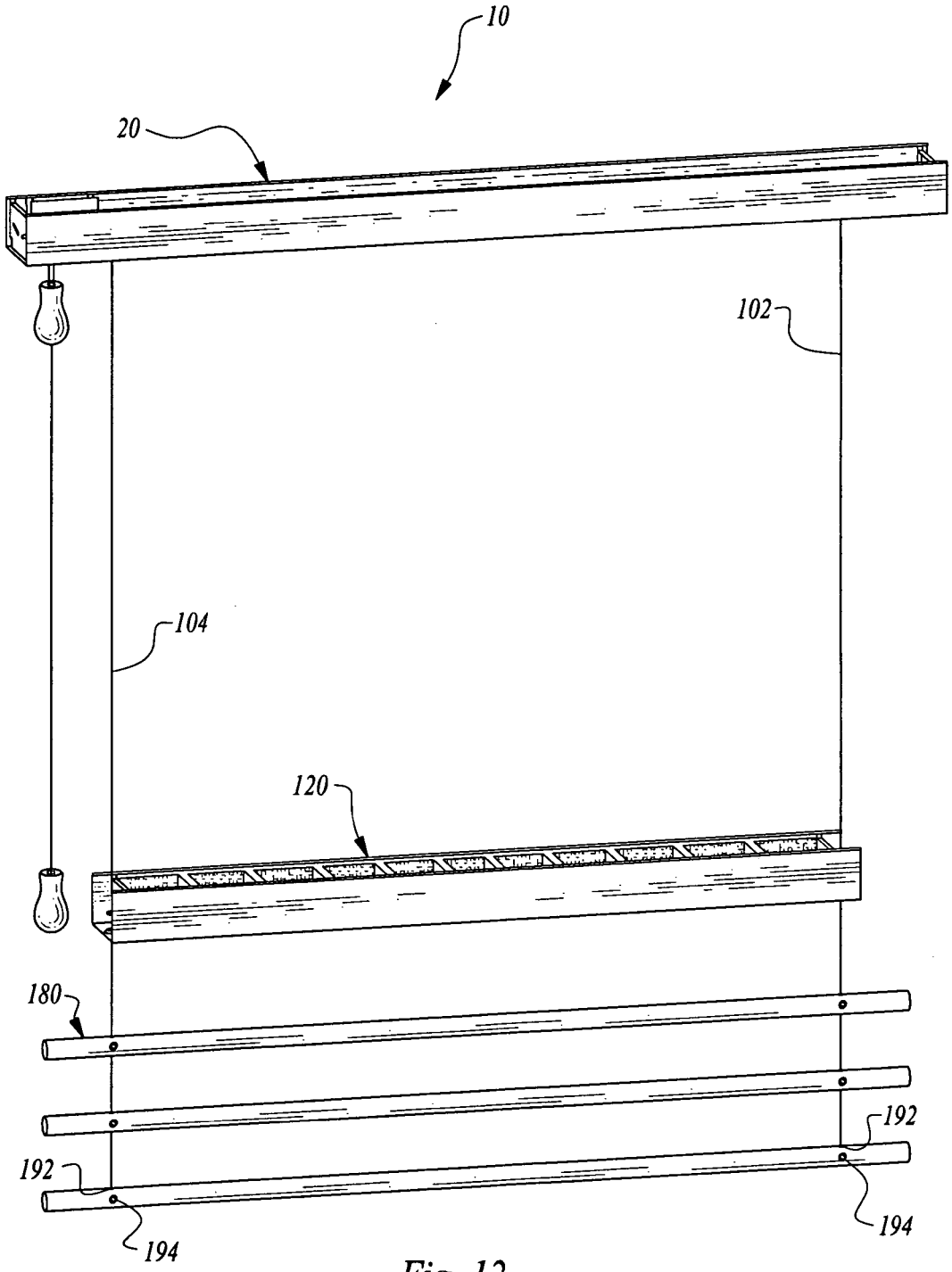
FIG. 12 is a back perspective view of the neckwear and jewelry storage device shown in an extended or lowered position.
Figure 13:
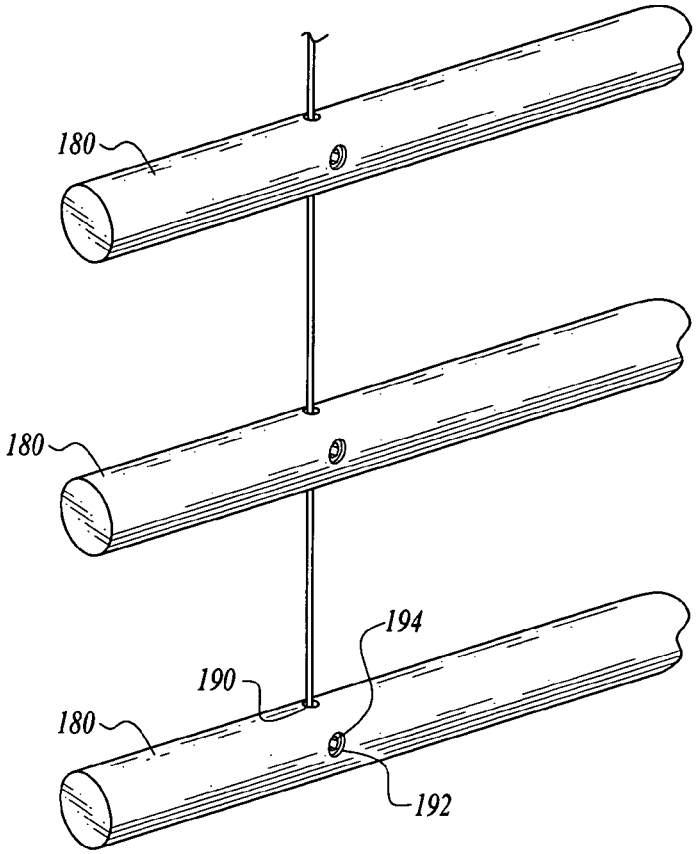
FIG. 13 is a fragmentary back perspective view of one end of a necktie rod assembly of the neckwear and jewelry storage device.

Referring back to FIG. 1 and to FIGS. 11 through 13, and in one embodiment, the neckwear and jewelry storage device 10 is further comprised of the plurality of necktie or neckwear rods 180 disposed beneath the jewelry tray or rail assembly 120. In one embodiment, each necktie rod 180 includes a cylindrically shaped body 182 having a circular cross section and extending between a first end 184 and a second end 186. Other geometric shapes may be alternatively employed for each necktie rod 180 such as a half moon or crescent moon shape or any one of a variety of polygon shapes. Additionally, and in one embodiment, each necktie rod 180 is formed from wood; however, each necktie rod may be formed from other materials such as metal or plastic.

Each of the plurality of necktie rods 180 includes a first cord aperture 188 disposed through its cylindrically shaped body 182 adjacent the first end 184 and a second cord aperture 190 disposed through its cylindrically shaped body 182 adjacent the second end 186. Additionally, each of the plurality of necktie rods 180 includes a set screw bore 192 disposed through its cylindrically shaped body 182 at an angel substantially perpendicular to the first cord aperture 188 and in open communication therewith such that a respective portion of the cord 102 passing through the first cord aperture 188 can be connected to the respective rod 180 by screwing a set screw 194 into the set screw bore 192 and clamping the respective portion of the cord 102 to the necktie rod 180. In like manner, each of the plurality of necktie rods 180 includes a set screw bore 192 disposed through its cylindrically shaped body 182 at an angel substantially perpendicular to the second cord aperture 190 and in open communication therewith such that a respective portion of the cord 104 passing through the second cord aperture 190 can be connected to the respective rod 180 by screwing a set screw 194 into the second set screw bore 192 and clamping the respective portion of cord 104 to the respective necktie rod 180.

Use and Operation

In use and operation, the neckwear and jewelry storage device 10 can be coupled to a ceiling such as a closet ceiling 200 (FIG. 14) or a wall with conventional wall anchors or conventional Venetian blind installation brackets.

Figure 14:
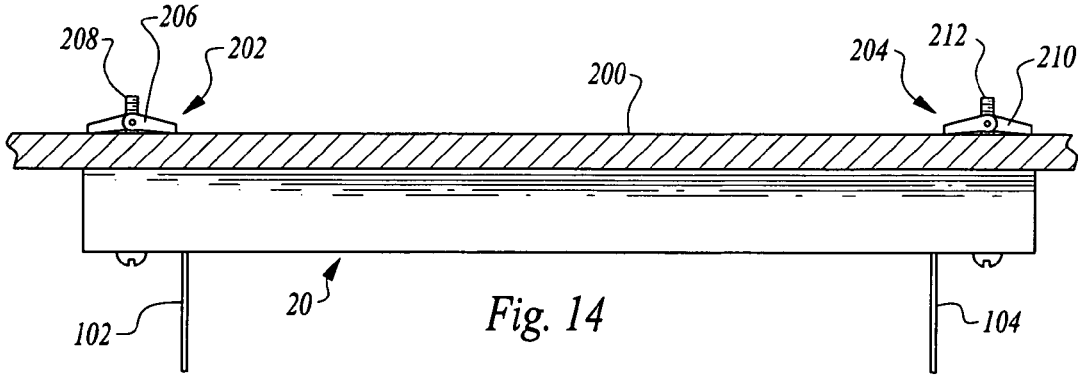
FIG. 14 is a side plan view of the head rail assembly of the neckwear and jewelry storage device connected to a ceiling.

In one embodiment, and referring to FIGS. 1 and 14, a pair of conventional toggle bolts 202, 204 are employed for installing the neckwear and jewelry storage device 10 to a hollow ceiling wall 200 of a closet just inside a closet door such that the device 10 descends from and ascends back up into an unused area between the top of the closet door and the ceiling thereby moving neckwear storage from the general clothes rod location to a location all its own. Additionally, jewelry storage is also moved to this location for convenient access.

Referring to FIGS. 1, 3, and 14, toggle bolt 202 is comprised of a collapsible spring loaded wing 206 and a bolt 208 and, in like manner, toggle bolt 204 is comprised of a collapsible spring loaded wing 210 and a bolt 212 such that bolt 208 is passed through the anchor aperture 56 and attached to wing 206 and bolt 212 is passed through the anchor aperture 58 and attached to wing 210. The wings 206 and 210 are then passed through ceiling apertures and allowed to expand. The bolts 208 and 212 are then tightened. Other conventional types of walls anchors and toggle bolts may be employed in conventional manners and in combination with the anchor apertures 56 and 58 for installing the neckwear and jewelry storage device 10 to a ceiling. Additionally, conventional Venetian blind installation brackets can be coupled to the head rail assembly 20 of the neckwear and jewelry storage device 10 in known conventional manners for installation of the device 10 to a wall or ceiling.

With the neckwear and jewelry storage device 10 installed, and referring to FIGS. 1, 6, 11, 12, and 14, a user grabs the second tassel 110 and pulls the tassel 110 in an inward and down motion which applies a force to the extension cord 108 and onto the cords 102 and 104 which results in the cam 90 sliding down the slots 92, 94 and releasing the cords 102 and 104 such that the jewelry tray or rail assembly 120 and the plurality of necktie rods 180 descend from the head rail assembly 20 by guiding the extension cord 108 upward or, in the alternative, ascend to the head rail assembly 20 by pulling the extension cord 108 downward. The step of guiding the extension cord 108 upward or alternatively pulling the extension cord 108 downward is followed by vertically straitening the extension cord 108 for griping the cam 90 and releasably locking the cords 102 and 104 between the cam 90 and the pulley 82. Hence, the neckwear and jewelry storage device 10 is raised or retracted (FIG. 11) or lowered or extended (FIG. 12) by use of a simple cord just as in raising or lowering window blinds such as Venetian or mini blinds.

In one aspect, the neckwear and jewelry storage device 10 moves necktie and jewelry storage from the general clothes rod location to a location all its own and can be installed on the ceiling of the closet just inside the closet door wherein the device 10 descends from that unused area between the top of the closet door and the ceiling. After necktie and jewelry such as tie tacks, cuff links, wrist watches are selected, the movable part of the device (jewelry assembly 120 and rods 180) can be made to ascend back up into that space over the closet door.

In one aspect, the neckwear and jewelry storage device 10 is designed to utilize a space that is a wasted and unused space in substantially all closets.

In one aspect, the neckwear and jewelry storage device 10 is capable of lowering neckties so that they appear together in horizontal fashion making color coordination with shirts a much more efficient task. Additionally, the device 10 allows the selection of accessories to be done in an efficient step free manner.

In another embodiment, the neckwear and jewelry storage device 10 is provided without the jewelry tray or rail assembly 120 for providing a neckwear only storage device.

In another embodiment, the neckwear and jewelry storage device 10 is provided without the plurality of necktie or neckwear rods 180 for providing a jewelry only storage device.

These aspects, along with the above delineation of the neckwear and jewelry storage device 10, including its use and operation; demonstrate the industrial applicability of this invention.

Moreover, having thus described the present invention, it should be apparent that numerous modifications and adaptations may be resorted to without departing from the scope and fair meaning of the present invention as set forth hereinabove and as described hereinbelow by the claims.

I claim:

1. A vertically adjustable combination neckwear and jewelry storage device comprising:

a head rail;

a cord lock device mounted in said head rail;

a plurality of cords running through said head rail and said cord lock, said plurality of cords extending from and below said head rail in a vertically spaced apart relation;

a plurality of spaced apart neckwear rods disposed substantially parallel to and vertically below said head rail, each of said plurality of spaced apart neckwear rods operatively coupled to each of said plurality of cords extending from and below said head rail so that a spacing between any two adjacent neckwear rods of said plurality of spaced apart neckwear rods is maintained;

a jewelry rail assembly disposed substantially parallel to and between said head rail and said plurality of spaced apart neckwear rods, said jewelry rail assembly operatively coupled to each of said plurality of cords extending from and below said head rail by a first of said plurality of cords passing through both a first eye bolt and a first cord eye guide both operatively coupled to a first end of said jewelry rail assembly in a vertically spaced relation and by a first knot provided in said first of said plurality of cords between said first eye bolt and said first cord eye and by a second of said plurality of cords passing through both a second eye bolt and a second cord eye guide both operatively coupled to a second end of said jewelry rail assembly in a vertically spaced relation and by a second knot provided in said second of said plurality of cords between said second eye bolt and said second cord eye guide so that a spacing between said jewelry rail assembly and said plurality of spaced apart neckwear rods is maintained; and wherein said cord lock includes means for retaining or releasing said plurality of cords for vertically raising or lowering said jewelry rail assembly simultaneously with said plurality of spaced apart neckwear rods relative to said head rail assembly for providing vertical adjustability and retention of said jewelry rail assembly and said plurality of spaced apart neckwear rods relative to said head rail.

2. The device of claim 1 wherein said jewelry rail assembly comprises an elongated jewelry rail body partitioned into a plurality of compartments.

3. The device of claim 2 wherein said plurality of compartments are upholstered.

4. The device of claim 3 wherein each of said plurality of upholstered compartments is comprised of a velvet layer overlying a foam layer.

5. The device of claim 1 wherein each of said plurality of spaced apart neckwear rods comprises a body that is cylindrically shaped and has a circular cross section.

6. The device of claim 1 wherein each of said plurality of spaced apart neckwear rods comprises a body that is at least partially cylindrically shaped.

7. The device of claim 1 wherein each of said plurality of spaced apart neckwear rods comprises a polygonally shaped body.

8. A vertically adjustable jewelry storage device comprising:

a head rail;

a cord lock device mounted in said head rail;

a plurality of cords running through said head rail and said cord lock device, said plurality of cords extending from and below said head rail in a vertically spaced apart relation;

a jewelry rail assembly disposed substantially parallel to and vertically below said head rail; said jewelry rail assembly operatively coupled to each of said plurality of cords extending from and below said head rail by a first of said plurality of cords passing through both a first eye bolt and a first cord eye guide both operatively coupled to a first end of said jewelry rail assembly in a vertically spaced relation and by a first knot provided in said first of said plurality of cords between said first eye bolt and said first cord eye and by a second of said plurality of cords passing through both a second eye bolt and a second cord eye guide both operatively coupled to a second end of said jewelry rail assembly in a vertically spaced relation and by a second knot provided in said second of said plurality of cords between said second eye bolt and said second cord eye guide; and wherein said cord lock device includes means for retaining or releasing said plurality of cords for vertically raising or lowering said jewelry rail assembly relative to said head rail for providing vertical adjustability and retention of said jewelry assembly relative to and vertically below said head rail.

* * * * *